US007793669B2

(12) United States Patent
Farano

(10) Patent No.: US 7,793,669 B2
(45) Date of Patent: Sep. 14, 2010

(54) DEVICE FOR DISPENSING A WASHING OR RINSING AGENT

(75) Inventor: Michele Farano, Turin (IT)

(73) Assignee: Elbi International S.p.A., Turin (IT)

( * ) Notice: Subject to any disclaimer, the term of this patent is extended or adjusted under 35 U.S.C. 154(b) by 938 days.

(21) Appl. No.: 11/534,013

(22) Filed: Sep. 21, 2006

(65) Prior Publication Data

US 2007/0062564 A1 Mar. 22, 2007

(30) Foreign Application Priority Data

Sep. 21, 2005 (IT) ..... TO2005A0651

(51) Int. Cl.
*B08B 13/00* (2006.01)

(52) U.S. Cl. ..... 134/93; 68/17 R

(58) Field of Classification Search ..... 134/94.1, 134/95.1; 68/17 R; 198/545, 548, 550.6, 198/550.1

See application file for complete search history.

(56) References Cited

U.S. PATENT DOCUMENTS

| | | | | | |
|---|---|---|---|---|---|
| 1,753,585 | A | * | 4/1930 | Umstead | 141/268 |
| 2,794,577 | A | * | 6/1957 | Leeuwen | 222/227 |
| 2,988,249 | A | * | 6/1961 | Wahl | 222/404 |
| 3,033,423 | A | * | 5/1962 | Anderson et al. | 222/161 |
| 3,240,400 | A | * | 3/1966 | Smith | 222/254 |
| 4,166,581 | A | * | 9/1979 | Hetrick | 239/683 |
| 4,207,995 | A | * | 6/1980 | Neely | 222/231 |
| 4,322,021 | A | * | 3/1982 | Olsson | 222/231 |
| 4,496,083 | A | * | 1/1985 | Gericke et al. | 222/231 |
| 4,895,274 | A | * | 1/1990 | Morimoto et al. | 222/63 |
| 4,917,272 | A | * | 4/1990 | Ikeda | 222/231 |
| 4,989,761 | A | * | 2/1991 | Ikeda | 222/231 |
| 5,002,421 | A | * | 3/1991 | Vrieze | 403/292 |
| 5,063,757 | A | * | 11/1991 | Ikeda et al. | 68/17 R |
| 6,951,230 | B1 | * | 10/2005 | Wegman | 141/256 |

FOREIGN PATENT DOCUMENTS

| | | |
|---|---|---|
| DE | 27 15 387 | * 10/1978 |
| DE | 35 28 128 | * 2/1987 |
| DE | 37 01 404 | * 8/1987 |

(Continued)

OTHER PUBLICATIONS

European Patent Office 0 520 956 Dec. 1992.*

(Continued)

*Primary Examiner*—Frankie L Stinson
(74) *Attorney, Agent, or Firm*—Sughrue Mion, PLLC

(57) ABSTRACT

The device for dispensing a washing or rinsing agent for a dishwashing machine comprises:

a container which has an inlet opening, which is adapted to be closed in a fluid-tight manner, for filling a quantity of a washing/rinsing agent inside the container;

an outlet opening which is adapted to be closed in a fluid-tight manner, for dispensing a quantity of washing/rinsing agent during an operating cycle of the device;

a feeder screw mounted rotatably inside the container, coaxial with the outlet opening and capable of conveying the washing/rinsing agent towards said outlet opening;

transmission members driven by a motor unit and able to impart a rotation to the screw during an operating cycle of the device; and a closing valve unit able selectively to free and close off in a fluid-tight manner the outlet opening.

8 Claims, 2 Drawing Sheets

FOREIGN PATENT DOCUMENTS

| | | | |
|---|---|---|---|
| DE | 40 00 646 | * | 7/1991 |
| DE | 41 24 525 | * | 1/1993 |
| DE | 102 12 184 | * | 10/2003 |
| FR | 2 743 576 | * | 7/1997 |
| JP | 01-317491 | * | 12/1989 |
| JP | 2001-034008 | * | 2/2001 |

OTHER PUBLICATIONS

European Patent Office 1 236 430 Feb. 2002.*

* cited by examiner

DEVICE FOR DISPENSING A WASHING OR RINSING AGENT

The present invention relates to a device for dispensing a washing or rinsing agent according to the preamble of claim 1.

One object of the invention is to provide a device for dispensing a washing or rinsing agent of the type which is simplified, low-cost and offers a high degree of reliability.

In order to achieve this object and other objects the subject-matter of the present invention concerns a device for dispensing a washing or rinsing agent which has the characteristic features of the accompanying claim 1.

Further characteristic features and advantages of the invention will become clear from the detailed description which follows, with reference to the accompanying drawings provided purely by way of a non-limiting example in which.

Figure 1:
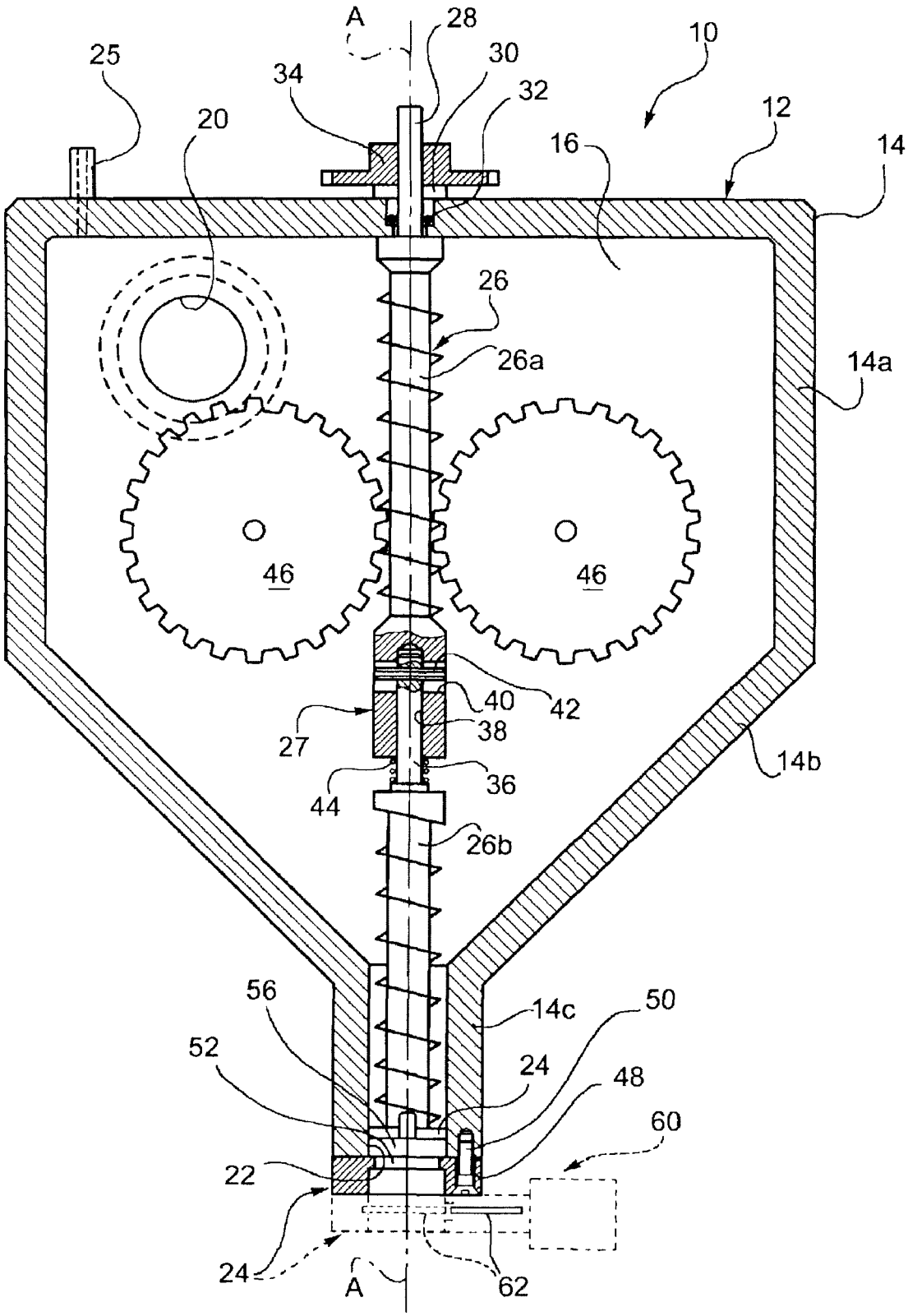
FIG. 1 is a front elevation view, sectioned along a longitudinal plane, of a preferred embodiment of a device for dispensing a washing or rinsing agent.

In connection with the detailed description which follows, the terms "vertical", "horizontal" and "transverse", "downwards" and "upwards", "top" and "base", "upper" and "lower" have been used to define positions and directions of different components. It is understood that these terms refer solely to the embodiment shown in the drawings only in order to define the relationship between its components in a purely conventional manner, and this must not be regarded as limiting the scope of the invention.

Figure 2:
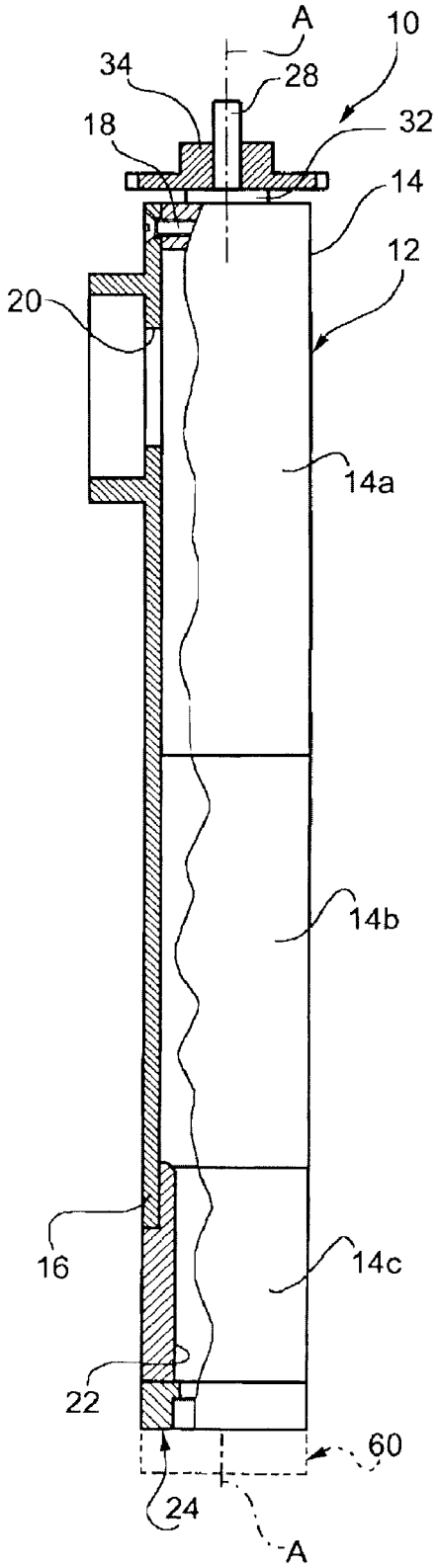
FIG. 2 is a partially sectioned side elevation view of the dispensing device according to FIG. 1.

With reference to FIGS. 1 and 2, 10 denotes overall a preferred embodiment of a device for dispensing a washing or rinsing agent, in particular suitable for installation in a dishwashing machine (not shown), according to the present invention.

The dispensing device 10 is able to release, during a working cycle thereof, a quantity of washing/rinsing agent in powder and/or gel and/or liquid and/or solid form and comprises a container 12 having a form which is substantially symmetrical and shaped in the manner of a hopper directed downwards.

With reference in particular to FIG. 1, the casing 12 comprises a tray 14 of variable width, starting with a widened upper portion 14*a*, which continues with a middle hopper-shaped portion 14*b*, connected to an end neck 14*c*. The tray 14 is connected to a lid 16 by means of, for example, screws or rivets 18 (only one of which is visible in FIG. 1) or using other known methods. In a portion thereof facing the widened portion 14*a*, the lid 16 has a transversely directed inlet opening 20 through which a user may fill the container 12 with a quantity of washing/rinsing agent. The inlet opening 20 can be closed in a fluid-tight manner after the container 12 has been filled, by means of mechanisms which are known per se, such as, by way of example, a spring cap (not shown).

The end of the end neck 14*c* is provided with an outlet opening 22 which is directed downwards and allows dispensing of a quantity of washing/rinsing agent during a working cycle of the dispensing device 10, and which can be selectively closed in a fluid-tight manner by means of closing members which are denoted overall by 24 and which will be described below. It can be noted how the form of tray 14, which is tapered towards the end neck 14*c*, in an advantageous manner helps direct easily the washing/rinsing agent, which is present in the container 12, towards the outlet opening 22.

On an upper side of the widened portion 14a of the tray 14 there is a conduct 25 communicating with the exterior and intended to allow a flow of air above the filling level of the container 12, in order to facilitate the outflow of the washing/rinsing agent through the outlet opening 22.

With reference to FIG. 1, the container 12 houses internally, in a substantially vertical direction, a worm or feeder screw 26 which is rotatably supported by the tray 14 and is able to rotate about its longitudinal axis A-A and is situated coaxially facing the outlet opening 22. The rotational movement of the screw 26 is such as to convey along with it in a manner known per se the washing/rinsing agent present in the container 12 towards the outlet opening 22.

The screw 26 is provided at the top with an end rod 28 passing through the upper wall of the widened portion 14*a* of the tray 14 and coaxial with the axis A-A. The end rod 28 is prevented from being displaced by means of a washer 30 situated outside the container 12 and is surrounded by an O-ring 32 (FIG. 1) inserted inside an opening of the tray 14. A transmission gear wheel 34 is keyed onto the end rod 28, is able to receive a rotational movement from motor members or devices (not shown) and transfer it to the screw 26 by means of this end rod 28.

As can be seen in FIG. 1, the screw 26 is advantageously divided into an upper portion 26*a* and a lower portion 26*b* which are coaxial, interconnected and locked rotationally with each other.

Preferably, the top of the lower portion 26*b* of the screw 26 has a spigot or lug 36 directed vertically and having an axis substantially coinciding with the axis A-A. The upper portion 26*a* of the screw 26 terminates at its base in a coupling assembly 27 which has a recess 38 arranged in a vertical direction and able to engage with the lug 36 along the axis A-A and also has a transverse through-hole 40. The through-hole 40 is adapted to house with vertical play a pin 42 able to be engaged in a fixed manner with the lug 36, for example by means of a force-fit.

In FIG. 1 it is possible to note furthermore that a compression-loaded spring 44 is conveniently arranged between the top of the lower portion 26*b* of the screw 26 and the coupling assembly 27 and is able to push and space from each other the abovementioned upper and lower portions 26*a*, 26*b* of the screw 26. The interconnection method described above results in the upper portion 26*a* and the lower portion 26*b* of the screw 26 being rotationally locked together.

Preferably, but not necessarily, the container 12 rotatably houses a pair of driven gear wheels 46 which mesh with the screw 26 and are rotationally driven by the latter. In this way the mixing/rinsing agent may be stirred and mixed, as well as being conveyed towards the outlet opening 22. This feature is particularly useful if the washing/mixing agent used is in the form of powder, since the movement of the gear wheels 46 may break up any accumulation of lumps which may have formed and which would risk blocking up the outlet opening 22. Obviously, for the purpose of reduced dimensions, it is also possible to prefer the use of only one of these gear wheels (condition not shown).

An example of the configuration of the closing members 24, mounted in accordance with the embodiment of the dispensing device 10 shown, will now be described.

Figure 3:
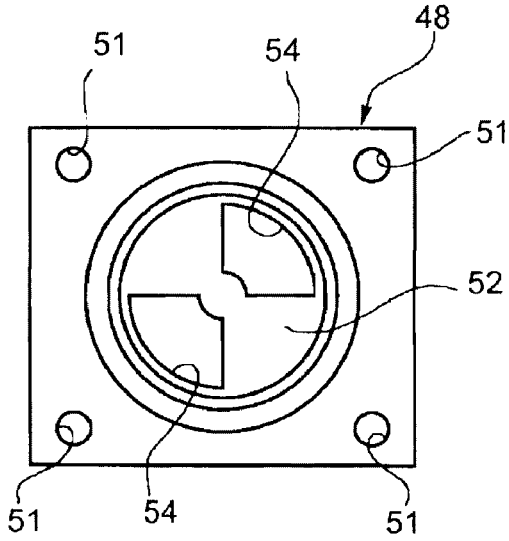
FIG. 3 is a plan view, on a larger scale, of a valve part used in the dispensing device according to the preceding figures.

With reference in particular to FIGS. 1 and 3, in the region of the outlet opening 22, a valve part 48 is fixed preferably on the end neck 14*c*, for example by means of four rivets 50 (only one of which is visible in FIG. 1) inserted inside respective peripheral holes 51 of this valve part 48 (FIG. 3). From what has been shown, it can be understood that the valve part 48 comprises a central diaphragm 52 facing the outlet opening 22 and having a pair of orifices 54 which are conveniently shaped, for example in the form of circular sectors with an angular amplitude of about 90°, and arranged at 180° relative to each other.

Figure 4:
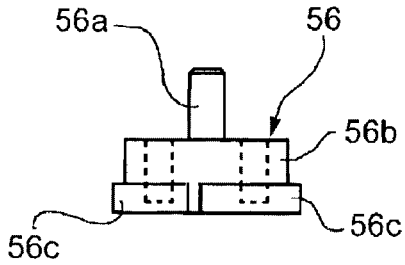
FIG. 4 is an enlarged side view of a butterfly shutter mounted in the dispensing device according to FIGS. 1 and 2.
Figure 5:
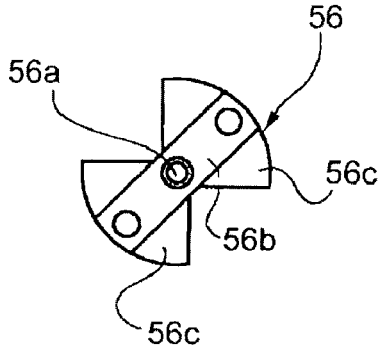
FIG. 5 is a plan view of the shutter shown in FIG. 4.

With reference to FIGS. 1, 4 and 5, it can be noted that, at the base of the lower portion 26*b*, the screw 26 has a butterfly shutter 56 facing the diaphragm 52 and able to slide rotating thereon. In FIG. 1 it is possible to see that the butterfly shutter 56 is oriented in a vertical direction coinciding with the axis A-A.

As can be seen more clearly in FIGS. 4 and 5, the butterfly shutter 56 comprises a stem 56*a* (FIGS. 4 and 5) inserted coaxially in the lower portion 26*a* of the screw 26. The stem 56*a* is fixed in the centre of a parallelepiped cross-piece 56*b*, at the base of which there is fixed a part 56*c* shaped in a way to complement the orifices 54, namely conveniently has a pair of circular sectors, which in the example shown have an angular amplitude of 90°, and are offset at 180° with relative to each other.

The configuration shown above envisages that the butterfly shutter 56 is rotationally locked with the screw 26.

In FIGS. 1 and 2, 60 denotes schematically an electrical control actuator, for example of the solenoid type, having associated therewith a movable shutter 62, which is co-operating with resilient return elements (not shown) and which is fixed to the base of the valve seat 48. In a manner known per se, the actuator 60 is able to be excited by a flow of electric current so as to induce a displacement of the movable shutter 62, bringing it from a sealingly closed position (shown in broken lines in FIG. 1) into an open position (shown in continuous lines in FIG. 1) against the action of the resilient return elements.

During assembly in a dishwashing machine (not shown), the dispensing device 10 is preferably fitted in the front door of the dishwashing machine, in such a way that:

- when the front door of the dishwashing machine is in the open position (i.e. in a substantially horizontal plane), the inlet opening 20 is conveniently directed upwards in order to facilitate filling of the container 12 by a user; and
- when the front door of the dishwashing machine is situated in the closed position (i.e. in a substantially vertical plane), the outlet opening 22 is conveniently directed downwards in order to facilitate dispensing of the washing/rinsing agent which is in the container 12.

The operating principle of the dispensing device 10 shown in the drawings will now be explained briefly.

During an inactive state of the dispensing device 10, where dispensing of the washing/rinsing agent is not required, the actuator 60 is not excited and the movable shutter 62 is kept by the resilient elements in the closed position. This prevents an undesirable outflow of washing/rinsing agent when the dishwashing machine is deactivated.

During an operating cycle of the dispensing device 10, during which a given quantity of washing agent is to be released, the actuator 60 is excited and therefore pushes the movable shutter into the open position, while the motor members rotationally drive the transmission gear wheel 34 which actuates the screw 26.

Consequently, the screw 26 causes in turn rotation of the driven gear wheels 46 and the butterfly shutter 56. The driven gear wheels 46 mix and stir the washing/rinsing agent, helping, together with the screw 26, to convey it towards the outlet opening 22 of the neck 14c of the tray 14.

Subsequently, when the washing/rinsing agent reaches the orifices 54, the shaped part 56*c* of the shutter 56 slides on the diaphragm 52 and acts in the manner of a blade, gradually and periodically freeing and closing off these orifices 54 during rotation about the axis A-A. Sliding of the shaped part 56*c* on the diaphragm 52 also facilitates the separation of any accumulation of solidified washing/rinsing agent from the orifices 54.

The movement of the screw 26 may be suitably adjusted and/or controlled temporally by the motor members, so as to produce the release of the desired quantity of washing/rinsing agent. For example, during the operating cycle of the dispensing device 10, a variation in the number of revolutions imparted to the screw 26 by the transmission gear wheel 34 and/or a variation in the activation time of this screw 26 results in a variation in the quantity of washing/rinsing agent dispensed. Therefore, the dispensing device 10 may be programmed by the user so that rotation of the screw 26 ensures advantageously adjustable metering of the washing/rinsing agent, for example depending on the load of the dishwashing machine.

In the event of the operating cycle of the dispensing device 10 suddenly being interrupted, the shaped part 56*c* could remain blocked in a position such that it does not cover completely the orifices 54, with the risk that the washing/rinsing agent continues to flow out towards the washing chamber of the dishwashing machine even when the latter is deactivated. However, with interruption in the flow of electric current in the actuator 60, the resilient return elements bring the movable shutter 62 back into the closed position, intercepting the flow of washing/rinsing agent out from the dispensing device 10.

The particular structure of the coupling assembly 27, which allows play in the vertical direction between the portions 26*a*, 26*b* of the screw 26 along the axis A-A, and the positioning of the spring 44 are useful for preventing blockage of the dispensing device 10. In fact, if a lump of powder or gel washing/rinsing agent should become lodged between the butterfly shutter 56 and the diaphragm 52, and if the screw 26 were to be formed as one piece, the screw 26 and the butterfly shutter 56 might not be able to push this lump beyond the diaphragm 52. Instead, the combined action of the spring 44 and coupling assembly 27 allows more effective expulsion of any lumps of washing/rinsing agent outside of the dispensing device 10.

In embodiments simplified (and not shown) in order to reduce the complexity and the overall costs of the dispensing device only the movable shutter 62 may also be envisaged the presence of the butterfly shutter 56 and the valve part 48 being excluded. Likewise it is also possible to consider the use of the butterfly shutter 56 alone together with the valve part 48, without using the movable shutter 62.

In other embodiments of the dispensing device, depending on requirements, it is also possible to direct the screw 26 and outlet opening 22, which are coaxial with each other, in the horizontal direction or also in an inclined direction, differently from that shown in the accompanying drawings, and also the shape of the container 12 may be different from that shown.

Naturally, the principle of the invention remaining the same, the embodiments and constructional details may be widely varied with respect to that described and illustrated, purely by way of a non-limiting example, without thereby departing from the scope of the invention as defined in the accompanying claims.

What is claimed is:

1. Device for dispensing a washing or rinsing agent, in particular for a dishwashing machine, comprising:

a container having:

an inlet opening which is adapted to be closed in a fluid-tight manner and is able to allow filling of a quantity of a washing/rinsing agent inside the container, an outlet opening which is adapted to be closed in a fluid-tight manner and is able to allow the dispensing of a quantity of washing/rinsing agent during an operating cycle of the dispensing device, and a feeder screw mounted rotatably about its longitudinal axis inside the container and situated in a position substantially coaxial with the outlet opening and capable of conveying the washing/rinsing agent towards said outlet opening;

transmission members driven by a motor unit and able to impart a rotation to the screw about its axis during an operating cycle of the device; and a closing valve unit able selectively to free and close off in a fluid-tight manner the outlet opening, wherein the closing valve means comprise a butterfly shutter for freeing and closing off selectively the outlet opening in a manner controlled by rotation of the screw; and wherein the screw comprises a first and a second portion which are interconnected with play in the direction of the axis of said screw, which are rotationally locked together and which are spaced by means of the action of resilient elements arranged between said first and second portions.

2. Device according to claim 1, in which the butterfly shutter is mounted coaxially with the screw and is locked rotationally with the latter, and the closing valve unit also comprise:

a valve part mounted on the container opposite the outlet opening and having at least one shaped orifice on which the butterfly shutter slides, gradually and periodically freeing and closing off said shaped orifice.

3. Device according to claim 2, in which the shaped orifices are a pair of shaped openings in the form of a circular sector having an angular amplitude of 90° and offset angularly at 180° with respect to each other, and the butterfly shutter has a shaped part with a form substantially complementing that of the orifices and slidable on them.

4. Device according to claim 1, in which the screw meshes with at least one gear wheel situated inside the container for stirring and mixing the washing/rinsing agent present in the container.

5. Device according to claim 4, in which the screw meshes with a pair of gear wheels situated inside the container.

6. Device according to claim 1, in which the container has a neck in which the outlet opening is formed and which directs the washing/rinsing agent towards said outlet opening.

7. Device according to claim 1, in which the closing valve unit comprises a movable shutter able to move between a closed position, where it closes the outlet opening, and an open position, where it frees said outlet opening as a result of the excitation of an electrically controlled actuating unit, against the action of a resilient return element.

8. Device according to claim 1, in which the motor unit allows controlled driving of the screw so as to perform dispensing of an adjustable quantity of the washing/rinsing agent for variable periods and quantities.

* * * * *